US007013621B2

(12) United States Patent
Shanklin et al.

(10) Patent No.: US 7,013,621 B2
(45) Date of Patent: Mar. 21, 2006

(54) ADJUSTABLE PACKAGE GEOMETRY WEB FORMING APPARATUS AND METHOD

(75) Inventors: Norman D. Shanklin, Wilton, NH (US); Robert J. Simonelli, Worcester, MA (US); William G. Peabody, Ashburnham, MA (US)

(73) Assignee: Shanklin Corporation, Ayer, MA (US)

( * ) Notice: Subject to any disclaimer, the term of this patent is extended or adjusted under 35 U.S.C. 154(b) by 0 days.

(21) Appl. No.: 10/464,701

(22) Filed: Jun. 18, 2003

(65) Prior Publication Data

US 2004/0255557 A1 Dec. 23, 2004

(51) Int. Cl.
*B65B 9/04* (2006.01)

(52) U.S. Cl. ..... 53/450; 53/479; 53/230; 53/553; 53/371.3; 53/371.7

(58) Field of Classification Search ..... 53/553, 53/230, 450, 479, 371.3, 371.7, 372.4, 372.5
See application file for complete search history.

(56) References Cited

U.S. PATENT DOCUMENTS

| | | | | |
|---|---|---|---|---|
| 2,391,547 A | | 12/1945 | Cohn et al. | 26/55 |
| 2,549,122 A | * | 4/1951 | Osterhof | 53/442 |
| 3,357,151 A | * | 12/1967 | Monaghan | 53/397 |
| 3,545,371 A | | 12/1970 | Reist | 100/176 |
| 3,552,088 A | * | 1/1971 | Niwa | 53/450 |
| 3,566,756 A | | 3/1971 | Schmid et al. | 93/84 |
| 3,586,229 A | | 6/1971 | Kamada et al. | 226/180 |
| 3,739,547 A | | 6/1973 | Brevko et al. | 53/182 |
| 3,869,846 A | * | 3/1975 | Timmerbeil | 53/553 |
| 3,980,295 A | | 9/1976 | Kleid | 271/242 |
| 4,007,865 A | | 2/1977 | Crandall | 226/17 |
| 4,009,877 A | | 3/1977 | Ward, Jr. | 271/272 |
| 4,072,611 A | | 2/1978 | Davis | 210/143 |
| 4,089,378 A | | 5/1978 | Suzuki | 169/54 |
| 4,219,988 A | | 9/1980 | Shanklin et al. | 53/550 |
| 4,262,473 A | | 4/1981 | Brooke | 53/450 |
| 4,519,185 A | | 5/1985 | Horn et al. | 53/550 |
| 4,650,406 A | | 3/1987 | Peters | 425/72 R |

(Continued)

FOREIGN PATENT DOCUMENTS

FR 2629790 * 4/1988

OTHER PUBLICATIONS

Shanklin Brochure for models HS-2 and HS-4 High Speed Automatic Wrappers; Qaulity Shrink Packaging Machinery.

*Primary Examiner*—Stephen F. Gerrity
*Assistant Examiner*—Hemant M. Desai
(74) *Attorney, Agent, or Firm*—Nields & Lemack

(57) ABSTRACT

Apparatus and method for the automatic packaging of one or more articles. An adjustable web guide structure that guides the webs of film into a configuration that mimics the geometry of a package to be wrapped is provided. The webs are conveyed over the guide structure, which structure provides an appropriate predetermined shape defining a web envelope for proper package entry and flow through the wrapping system. The position and geometry of the guides causes the web envelope to form around the corners of the product to be package to minimize film requirement, and allows for fluid transition from web supply rolls to package shape. External tension rods can be used to assist in preventing or minimizing web wrinkling. Guide rolls can be used in conjunction with the guide structure to assist in guiding and tracking the web material, as well as to provide axial transverse tension for proper web forming.

17 Claims, 4 Drawing Sheets

U.S. PATENT DOCUMENTS

| | | | | | |
|---|---|---|---|---|---|
| 4,671,047 | A | | 6/1987 | Mugnai | 53/550 |
| 4,761,937 | A | | 8/1988 | Francioni | 53/550 |
| 4,774,800 | A | | 10/1988 | D'Angelo | 53/553 |
| 4,779,399 | A | | 10/1988 | Diez et al. | 53/450 |
| 4,909,425 | A | | 3/1990 | Susini et al. | 226/17 |
| 5,137,505 | A | | 8/1992 | Ishii et al. | 493/248 |
| 5,269,122 | A | * | 12/1993 | Reichental et al. | 53/450 |
| 5,357,731 | A | * | 10/1994 | Conway et al. | 53/374.4 |
| 5,497,720 | A | | 3/1996 | Kawasaki | 112/153 |
| 5,519,983 | A | | 5/1996 | Moen | 53/442 |
| 5,735,107 | A | * | 4/1998 | Vollenweider et al. | 53/450 |
| 5,921,067 | A | | 7/1999 | Fujiwara et al. | 53/550 |
| 5,956,931 | A | | 9/1999 | Stork | 53/550 |
| 5,979,145 | A | * | 11/1999 | Louis et al. | 53/439 |
| 5,987,860 | A | | 11/1999 | Yang | 53/550 |
| 5,989,172 | A | | 11/1999 | Achelpohl | 493/189 |
| 6,115,999 | A | * | 9/2000 | Adelman | 53/465 |
| 6,178,723 | B1 | * | 1/2001 | Mossbeck | 53/450 |
| 6,256,969 | B1 | * | 7/2001 | Fragstein | 53/553 |
| 6,419,138 | B1 | | 7/2002 | Takahashi et al. | 226/88 |
| 6,457,300 | B1 | | 10/2002 | Yang | 53/550 |
| 2002/0014508 | A1 | | 2/2002 | Freerman | 226/20 |

* cited by examiner

ADJUSTABLE PACKAGE GEOMETRY WEB FORMING APPARATUS AND METHOD

FIELD OF THE INVENTION

The present invention relates to automatic package wrapping apparatus and a method of automatically wrapping packages with film, preferably heat sealable film. In particular, the present invention relates to an adjustable assembly for package wrapping apparatus that pre-forms and maintains the film in a suitable configuration to receive one or more packages that are moving continuously at a variable rate of speed through the apparatus. The apparatus of the present invention is especially suitable for high profile packages.

BACKGROUND OF THE INVENTION

Automatic wrapping or packaging machines are designed to wrap products in flexible sheets of plastic film, typically heat sealable thermoplastic shrink film, fully automatically at speeds that can approach 200 linear feet per minute, depending upon the package and the application. Briefly, products to be packaged are continuously fed into the wrapping machine on a conveyor. A single sheet of flat film is delivered to a forming plow from an overhead powered film unwind or an inverting head from a rear powered film unwind. The size and shape of the forming plow or the inverting head depends upon the size and profile of the product to be packaged. As the film is drawn over the forming plow or the inverting head, it is inverted and forms a tube of film inside the forming plow or the inverting head into which the product is conveyed. The product enters this tube of web material and the product itself serves to maintain the shape of the tube as the product and film then continues through the machine in unison. The two edges of the single web of film are overlapped on the bottom, side, or top of the product and are sealed together, such as with a static sealing system or a thermal sealing system. The product passes through end seal jaws that seal in between the packages and concurrently sever individual packages from the tube of film. The wrapped package then typically proceeds to a shrink tunnel located at the discharge end of the wrapping machine, which shrinks the thermal film tightly around the product. Occasionally, the wrappers are used to perform containment bagging functions only without the use of a shrink tunnel.

Wrapping or packaging machines that utilize two webs of material, one fed from above the product and one fed from below, that automatically wrap around the product and are sealed also are known.

One example of conventional automatic wrapping machines that uses an inverting head instead of a plow to invert the film and form the tube into which the product is conveyed is shown in U.S. Pat. No. 4,219,988. An inverter head is positioned at a 45° angle with respect to the direction of package flow, and the sheet of film fed from an unwind wraps around the head and is inverted (the outside surface of the film web becomes the inside as the web forms around the head). As the package emerges from the vicinity of the inverting head, the film is enveloped around it. The wrapped package proceeds to a thermal side seal unit, and eventually to the end seal unit.

Machines such as these function well for low profile products and are used pervasively for such applications. However, as the height or profile of the products to be packaged increases, the geometric shape and scale of size of the inverting head or the forming plow become unmanageable in size for practical use. The forming plow is affected by the width of the web passing over it. The inverting head is affected by the length of cantilever extension. As a result, significant web tracking problems arise from material handling issues of that scale. The result is substantial difficulty in the execution of the wrapping process, unattractive finished product, and/or complete inability to wrap product.

It is therefore an object of the present invention to provide an apparatus and method for effectively wrapping high profile products.

It is another object of the present invention to provide a guide system for guiding the webs to form and maintain a predetermined geometric shape, independently of the location of the product, the shape being configured to envelope a product to be packaged.

It is a further object of the present invention to provide an apparatus and method for reliable and quality automatic wrapping of products utilizing two webs of flexible, sealable material while avoiding web-tracking problems.

Other objects and features of the present invention will become apparent from the following description and drawings.

SUMMARY OF THE INVENTION

The problems of the prior art have been overcome by the present invention, which provides an apparatus and method for the automatic packaging of one or more articles. More specifically, the present invention includes an adjustable web guide structure that guides the webs of film into a configuration that mimics the geometry of a package to be wrapped. The webs are conveyed over the guide structure, which structure provides an appropriate predetermined shape defining a web envelope for proper package entry and flow through the wrapping system. The position and geometry of the guides causes the web envelope to form around the perimeter of the product to be package to minimize film requirement, and allows for fluid transition from web supply rolls to package shape. Preferably the guide structure assembly extends deep into the machine direction profile, thereby maintaining the appropriate shape even during a side sealing operation. External tension rods and fold transition rods can be used to assist in preventing or minimizing web wrinkling.

In a further embodiment of the present invention, guide rolls are used in conjunction with the guide structure to assist in guiding and tracking the web material, as well as to provide axial transverse tension for proper web forming. The guide rolls reduce or eliminate web walk-out.

DETAILED DESCRIPTION OF THE INVENTION

Figure 1:
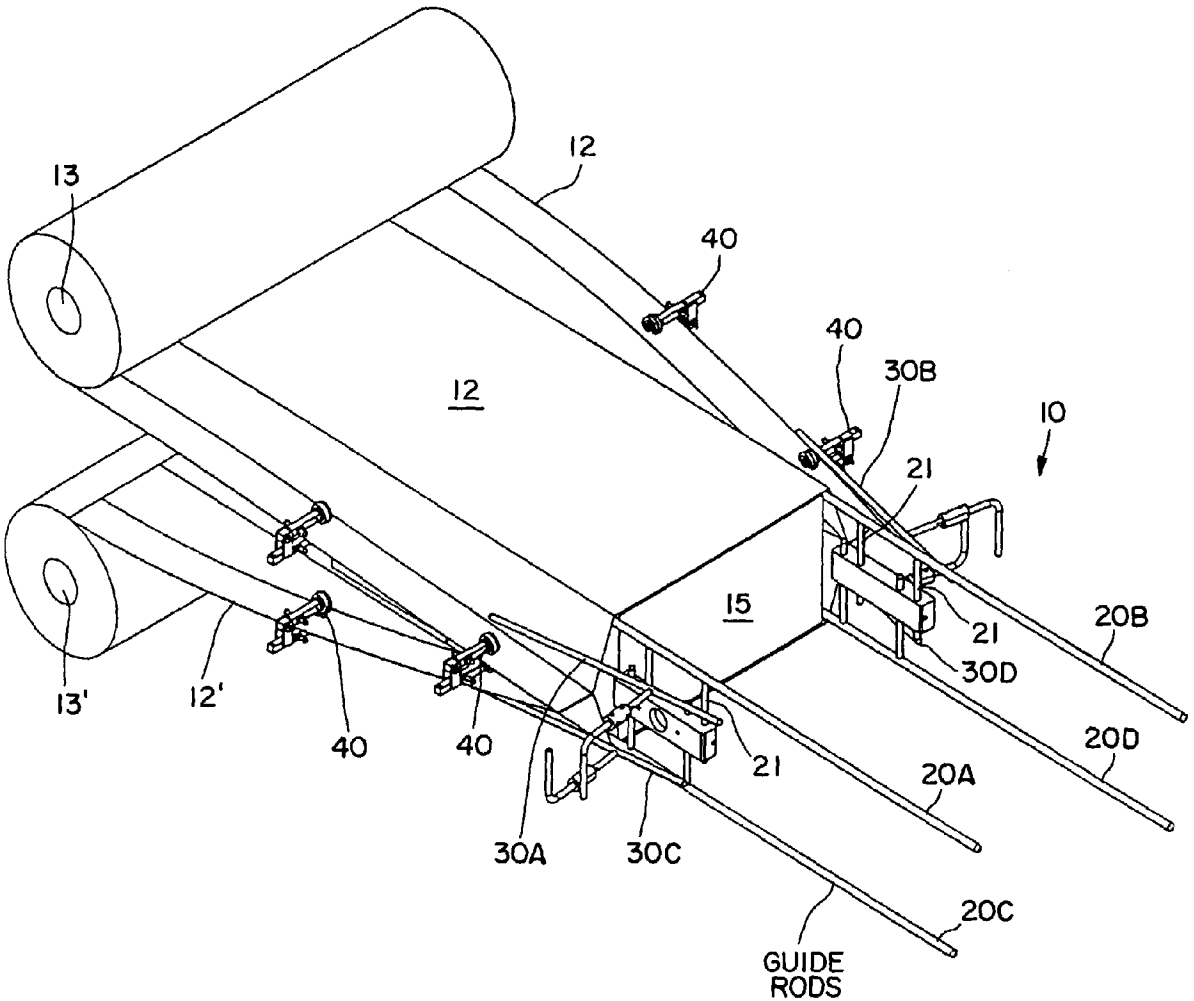
FIG. 1 is a perspective view of the adjustable guide assembly in accordance with the present invention.
Figure 2:
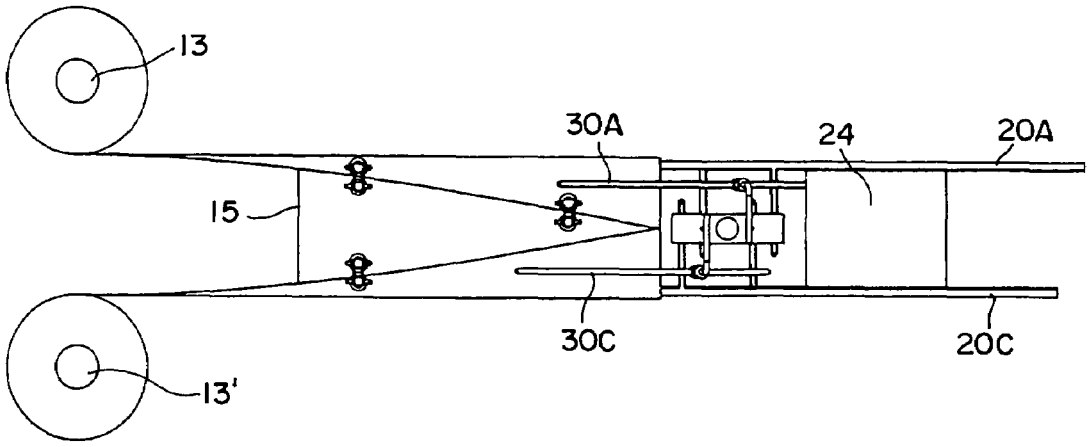
FIG. 2 is a front view of the assembly of FIG. 1 in accordance with the present invention.
Figure 3:
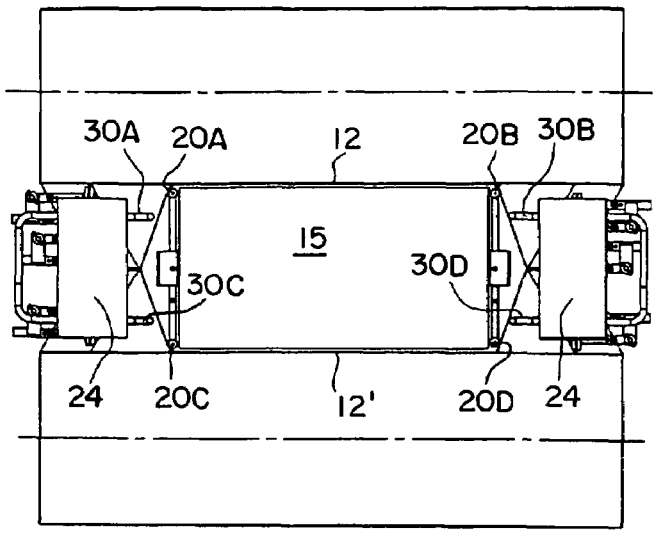
FIG. 3 is an end view of the assembly of FIG. 1 in accordance with the present invention.
Figure 4:
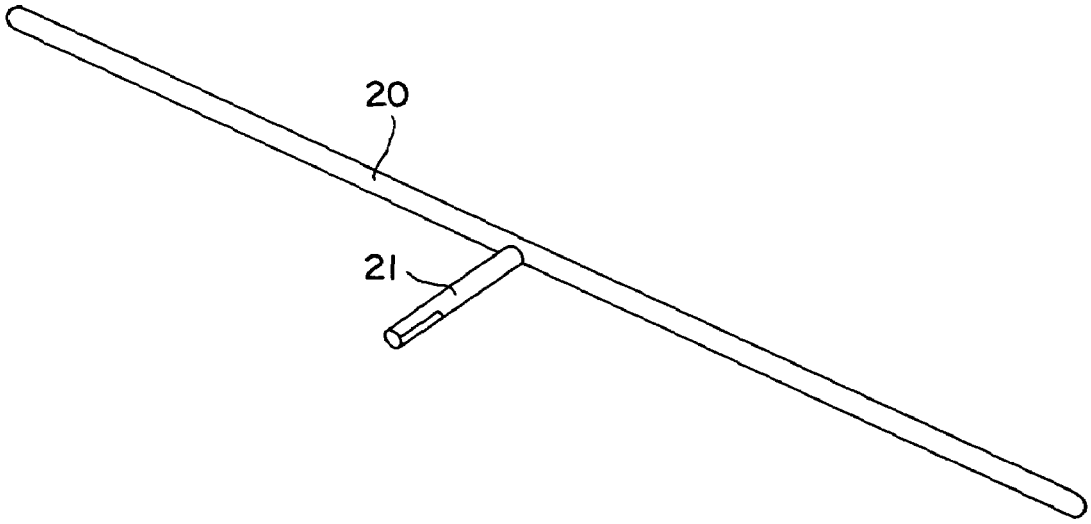
FIG. 4 is a perspective view of a guide rod that forms part of the guide assembly in accordance with the present invention.

Turning now to FIGS. 1–3, there is shown generally at 10 a web guide assembly in accordance with the present invention. An upper web of film 12 is fed from a top web supply unwind 13 in the direction of travel of the product 15 to be packaged. A lower web of film 12' is similarly fed from a bottom web supply unwind 13' spaced from the top unwind 13, also in the direction of travel of the product 15 to be packaged. Preferably the products to be packaged are inputted to and conveyed through the wrapping machine by an automatic conveyor in a linear, horizontal path in between the two webs of film as is well known to those skilled in the art. Where multiple products are conveyed, the input of the products to the machine is timed so that a suitable spacing between products is provided. It is also within the scope of the present invention to manually feed product into the machine.

Positioned downstream of the product input and in the path of web travel is the guide system 10 of the present invention. The guide system 10 includes one or more strategically placed web-guiding members located within an upper and lower web envelope created by the guided film. Preferably the guide members are formed of a rigid material such as metal, particularly stainless steel, although other suitable materials can be used. In the embodiment shown, the guide members 20 are elongated cylindrical stainless steel rods, although those skilled in the art will appreciate that guide members with other configurations can be used, provided they provide effective guidance of a continuously moving web and do not interfere with the wrapping process. The diameter or thickness of the guide members is not particularly limited, although it should be sufficient to adequately support the web and should not be so large that it interferes with the travel of the package being wrapped. The guide members should extend in the direction of product travel towards the film unwinds a sufficient distance to allow for proper formation of the web envelope, and should extend a distance in the opposite direction at least far enough along the path of product travel to allow the trailing end of the product to enter the envelope, and preferably extend past the side sealing mechanisms 24 (FIG. 2) so that the web envelope is maintained by the guide members at least until the side sealing operation is carried out. This also ensures that the proper amount of web selvage is guided in a controlled flow through each of the dual opposing side seals. The length of the guide members can be adjustable, such as by providing telescoping tubes that can be locked in position, or by simply attaching suitable extensions.

With particular reference to FIG. 1, a pair of upper guide members 20A, 20B are positioned in spaced relation to receive and guide the upper web 12. The distance between upper guide members 20A and 20B, in the cross-machine direction, is dependent upon the upper width of the product 15 being packaged, and preferably is set to be slightly greater than that width in order to accommodate travel of the product 15 between the members 20A, 20B without contact therewith. Importantly, the upper web 12 is conveyed over the guide members 20A, 20B, such that the guide members 20A, 20B are actually positioned inside the envelope created by the webs 12, 12'; i.e., between the web and the product to be packaged. No inversion of the film is necessary.

The guide members 20A, 20B can be supported in position by any suitable means well within the skill in the art. For example, each member 20A, 20B can be supported by spaced vertically extending support members 21 that each are coupled at one end to a guide member, and at an opposite end to a supporting substrate such as the frame of the wrapping machine. The vertically extending support members 21 are preferably adjustable in length, such as by having telescoping portions, in order to readily adjust the height of the particular guide members being supported. The support members 21 also can be pivotally attached to the guide members so that the position or angle of a guide member with respect to the moving web can be changed without removing the support.

A pair of lower guide members 20C, 20D are positioned in spaced relation to receive and guide the lower web 12' The distance between lower guide members 20C and 20D, in the cross-machine direction, is dependent upon the lower width of the product 15 being packaged, and preferably is set to be slightly greater than that width in order to accommodate travel of the product 15 between the members without contact therewith. Importantly, the lower web 12' is conveyed under the guide members 20C, 20D, such that the guide members 20C, 20D are actually positioned inside the envelope created by the webs 12, 12'. The guide members 20C, 20D can be supported in position by any suitable means well within the skill in the art, in a manner similar to upper guide members 20A, 20B as discussed above.

Lower guide member 20C can be attached to upper guide member 20A, if desired, which can facilitate adjusting the vertical spacing between the two guide members (and thus the height of the web envelope formed around the guide members) to accommodate the product to be packaged. Similarly, lower guide member 20D can be attached to upper guide member 20B. Alternatively, the guide members can be separate and independently adjustable to vary the height.

The web envelope formed by the guide members need not be rectangular in cross section; the web envelope geometry can be configured based upon the package geometry. The length of the upper guide members 20A, 20B need not correspond to the length of the lower guide members 20C, 20D, such as in instances where the product to be packaged is shaped so that the top of the product enters the web envelope before or after the bottom. For example, in instances where the top of a product 15 enters the web envelope prior to web entry of the bottom of the product, the upper guide members can be longer than the lower guide members to accommodate this shape. Similarly, the relative distance between guide members 20A, 20C can differ from the relative distance between guide members 20B, 20D, such as where the product to be packaged is higher on one side than the other. Accordingly, based upon the known package geometry, the relative positions of each of the guide members can be predetermined and set to accommodate the particular package geometry.

Those skilled in the art will appreciate that for irregularly shaped products, more than four guide members can be used to assist in forming and/or maintaining the web envelope.

FIGS. 1–3 also illustrate external transition rods 30 that can be used in addition to the guide rods 20. In the embodiment shown, four such transition rods 30A, 30B, 30C, 30D are used, two opposite upper rods 30A, 30B for the upper web 12, and two opposite lower rods 30C, 30D for the lower web 12'. The transition rods 30 are positioned externally to the web enveloped (relative to the location of the product to be packaged) formed by the guide rods 20. Their function is to guide the web transition from the roll stock 13, 13' to the package form. Preferably the tension rod(s) are positioned at an angle (relative to the side sealers 24) in the vicinity of the side sealers 24 to help avoid the formation of wrinkles in the moving webs. The particular angle used will depend upon the geometry of the web envelope being formed, and will become apparent to one skilled in the art. Since the angle of the transition rods 30 is adjustable, the transition rods are pivotally coupled to suitable supporting structure.

Figure 5:
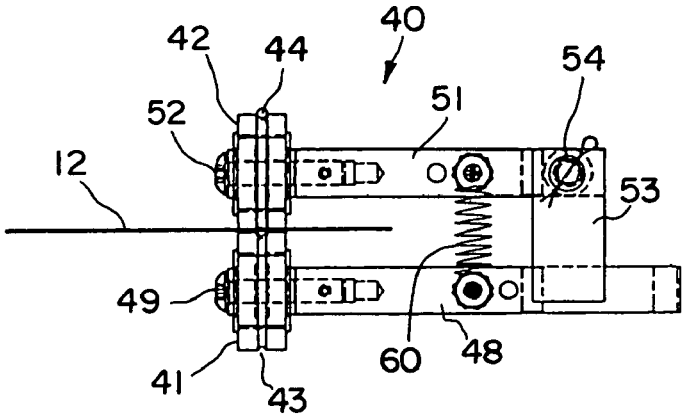
FIG. 5 is a side cross-sectional view of guide rolls in accordance with another embodiment of the present invention.
Figure 6:
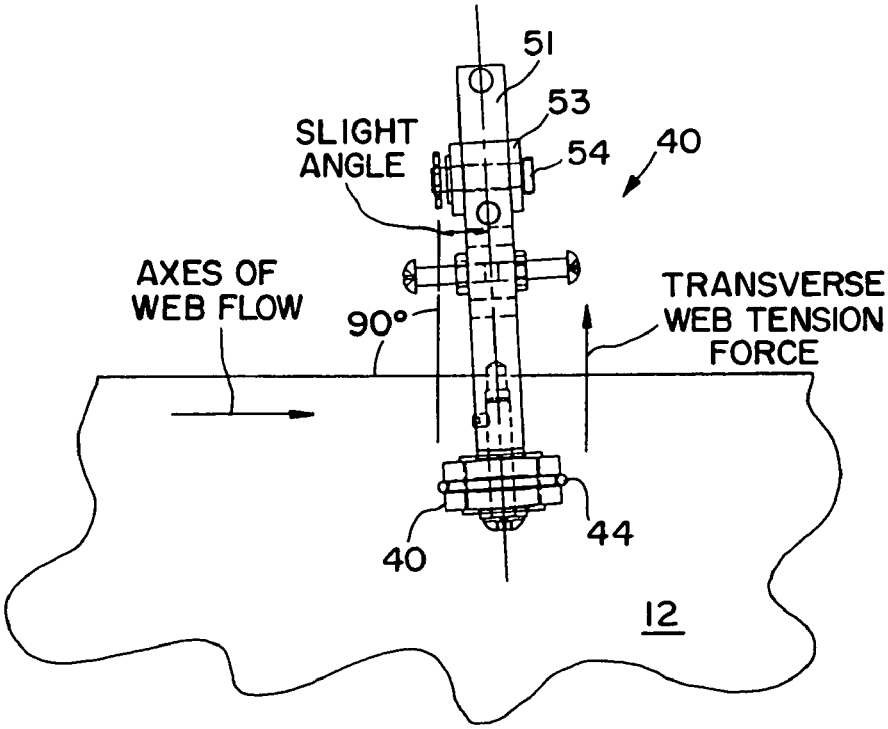
FIG. 6 is a top cross-sectional view of the guide rolls of FIG. 5 in accordance with the present invention.

Turning now to FIGS. 5 and 6, guide roll assembly 40 is shown that can be used in conjunction with the guide member assembly of the present invention. Each guide roll assembly 40 includes two opposing rolls, a first roll 41 having a portion of reduced diameter, and a second roll 42 having a portion of increased diameter. Preferably each roll has a rubber-coated surface for good frictional traction. In a preferred embodiment, the portion of reduced diameter in the first roll 41 is a concave radial groove 43 centrally located on the roll, and the portion of increased diameter in the second roll 42 is a corresponding convex raised radial ring 44 also centrally located on the roll. The convex radial ring 44 can be formed integrally with the roll 42, or can be formed with an O-ring attached to the roll by suitable means. Similarly, the concave groove 43 can be formed integrally with the roll 42, or can be carved into the roll by suitable means. The convex radial ring 44 and concave groove 43 are configured so that upon alignment of rolls 41 and 42 (i.e., such that rolls 41 and 42 have parallel axes of rotation), the ring 44 is received in groove 43.

Roll 41 is rotatingly coupled to a shaft 48 by a screw or pin 49. Similarly roll 42 is rotatingly coupled to a shaft 51 by a screw or pin 52. The shafts 48, 51 can be pivotally connected, such as at or near their respective ends opposite the ends supporting the rolls 41, 42, by a connecting brace 53 fixed to one shaft (shaft 48 in the embodiment shown) and pivotally connected to the other shaft (shaft 51 in the embodiment shown) via pin 54. This allows the pivoting of shaft 51 (and therefore roll 42) with respect to shaft 48 (and roll 41), and enables the insertion of the web of film between the rolls. The rolls 41, 42 are preferably biased towards one another via spring 60 coupled at its opposite ends to each shaft as best seen in FIG. 5. The pressure exerted by the spring may be adjustable, depending upon the desired amount of pressure to be exerted on the sandwiched web.

Each roll assembly 40 is positioned with respect to the traveling web of film such that the web 12 (or 12') can be continuously fed, at or near its opposite side edges, between the two rolls 41, 42. The spring 60 causes the web to be held between the two rolls with light pressure. The web is particularly contained between the increased diameter portion 44 of roll 42 and the reduced diameter portion 43 of roll 41, thereby preventing the web from releasing from the rolls as is typical with flat faces. As the web travels between the two rolls, the rolls rotate in opposite directions. Thus, by trapping the web in the groove 43, the walking-out phenomenon pervasive in conventional wrapping machines is retarded or completely eliminated. Multiple guide roll assemblies 40, arranged at spaced longitudinal intervals in the direction of web travel, can be used on each side of each web as illustrated in FIG. 1. Those skilled in the art will be able to readily determine optimum spacing of the assemblies.

In a preferred embodiment, each guide roll assembly 40 is oriented at a slight angle with respect to the axis of web travel. With the axis of rotation of the rolls so cantered, a transverse axial tension is applied to the web for optimal web control. This is particularly important when using two opposing side seal web sealing techniques, as the web otherwise tends to not track properly through the opposing side seal units. Suitable angles include from about 0° to about 5°, with 2–3° being particularly preferred.

In operation, the guide members 20 are oriented and spaced based upon the configuration of the product to be packaged. Upper web 12 is threaded through upper guide roll assemblies 40 when present, and over upper guide members 20A, 20B. Similarly, lower web 12' is threaded through lower guide roll assemblies 40 when present, and under lower guide members 20C, 20D. A web envelope is thus formed and maintained by the guide members, the envelope being of a suitable geometry to receive the product to be packaged. Product is conveyed towards the envelope, preferably at the same speed and direction that the upper and lower webs are traveling. Where multiple products are to be wrapped, the products are suitable spaced apart to allow the leading and trailing ends of each product to be wrapped by the webs and sealed such as by an end sealer without interfering with a neighboring product, in a manner known to those skilled in the art. The product proceeds into the envelope and towards opposite dual side seal units, where the lateral edges of the upper and lower webs are sealed and severed. Since the guide members 20 preferably extend past the side seal units and thereby maintain the web envelope past the side seal units, this side sealing operation can begin even before the product to be packaged reaches the side seal units. The side seal operation also severs any web selvage created by the seal. The wrapping at the leading end of the product is then sealed by an end sealer, followed by the sealing of the wrapping at the trailing end of the product (and concurrently sealing the wrapping of the leading edge of the next product). The wrapped package then typically proceeds to a heat tunnel where the wrapping is heated to shrink tightly about the package as is known in the art. Alternatively, the heat shrinking can be eliminated where merely bagging of the product is desired,

What is claimed is:

1. An automatic film wrapping machine for wrapping a product traveling through said machine, comprising:

a supply of an upper web of film;

a supply of a lower web of film spaced from said upper web of film;

a film guide assembly for pre-forming said upper and lower webs of film into a web envelope having a predetermined configuration to receive said product, said film guide assembly comprising at least one upper guide member positioned to receive said upper web of film, and at least one lower guide member positioned to receive said lower web of film, wherein said at least one upper guide member and said at least one lower guide member are positioned inside said web envelope and such that the distance between said upper and lower webs of film in said web envelope is greater than the height of said product; and opposite side seal mechanisms for sealing together said upper and lower webs of film, and wherein said upper and lower guide members extend past said side seal mechanisms in the direction of product travel.

2. The automatic film wrapping machine of claim 1, wherein said film guide assembly comprises first and second spaced upper guide members and first and second spaced lower guide members.

3. The automatic film wrapping machine of claim 1, further comprising at least one guide roll assembly positioned in the path of at least one of said upper and lower web, said guide roll assembly comprising a first roll having a portion of reduced diameter and a second roll having a portion of increased diameter, said at least one of said upper and lower webs being sandwiched between said first and second rolls.

4. The automatic film wrapping machine of claim 3, wherein said at least one guide roll assembly is oriented such that said first and second rolls are positioned to rotate along an axis at an angle greater than zero with respect to the axis of travel of at least one of said upper or lower webs.

5. The automatic film wrapping machine of claim 1, further comprising at least one tension member positioned outside said web envelope.

6. A web guiding assembly for guiding two traveling webs about a package to be wrapped by said webs, said package having a geometry, said assembly comprising a plurality of spaced guide members positioned to intercept said traveling webs and cause said webs to form an envelope having a predetermined shape suitable for receiving and enveloping said package geometry, said guide members maintaining said envelope independently of the location of said package, and opposite side seal mechanisms for sealing together said two webs of film, and wherein said spaced guide members extend past said side seal mechanisms in the direction of product travel.

7. The web guiding assembly of claim 6, further comprising at least one guide roll assembly positioned in the path of at least one of said upper and lower web, said guide roll assembly comprising a first roll having a portion of reduced diameter and a second roll having a portion of increased diameter, said at least one of said upper and lower webs being sandwiched between said first and second rolls.

8. The web guiding assembly of claim 7, wherein said at least one guide roll assembly is oriented such that said first and second rolls are positioned to rotate along an axis at an angle greater than zero with respect to the axis of travel of at least one of said upper or lower webs.

9. A method of wrapping a product in a film, comprising:

conveying said product along a predetermined path of travel in a predetermined direction;

advancing an upper web of film in said direction adjacent said path of travel, said upper web having an upper web leading end, an upper web trailing end, a first upper web lateral side and a second upper web lateral side;

advancing a lower web of film in said direction adjacent said path of travel and spaced from said upper web of film, said lower web having a lower web leading end, a lower web trailing end, a first lower web lateral side and a second lower web lateral side; providing side seal mechanisms;

forming a web envelope in said path of travel by guiding said upper web of film about at least one upper guide member and by guiding said lower web of film about at least one lower guide member, said at least one upper guide member and said at least one lower guide member being positioned inside said web envelope and such that the distance between said upper and lower webs of film in said web envelope is greater than the height of said package; and wherein said upper and lower guide members extend past said side seal mechanisms;

causing said package to travel into said envelope;

sealing, within said web envelope, said first upper web lateral side to said first lower web lateral side and said second upper web lateral side to said second lower web lateral side; by use of the side seal mechanisms sealing said leading end of said upper web to said leading end of said lower web; and sealing said trailing end of said upper web to said trailing end of said lower web.

10. The method of claim 9, further comprising heat shrinking said film wrapped about said product.

11. The method of claim 9, wherein said envelope is maintained independently of the location of said product.

12. The method of claim 9, wherein said envelope is maintained during said sealing of said lateral sides.

13. The method of claim 9, further comprising tensioning one of said upper and lower webs in a direction transverse to said path of travel.

14. The method of claim 13, further comprising tensioning the other of said upper and lower webs in a direction transverse to said path of travel.

15. Apparatus for individually wrapping a plurality of products with a film, comprising:

a conveyor defining a horizontal path for the movement of said products in a predetermined spaced relationship;

a first supply of film for supplying an upper web of film along said path;

a second supply of film for supplying a lower web of film along said path;

a guide assembly comprising at least one upper guide member for intercepting said upper web and guiding and maintaining said upper web in a first predetermined position, and at least one lower guide member for intercepting said lower web and guiding and maintaining said lower web in a second predetermined position, whereby said first and second predetermined positions define a web envelope configured to receiving each of said products as they travel in said horizontal path, and said upper guide member and said lower guide member are positioned inside said web envelope and such that the distance between said upper and lower webs of film in said web envelope is greater than the height of each said product; and film sealing and cutting apparatus within said web envelope for sealing said upper and lower films about each of said products; wherein said sealing apparatus comprises a side seal mechanism, and wherein said upper and lower guide members extend past said side seal mechanism.

16. The apparatus of claim 15, further comprising at least one guide roll assembly comprising a first roll having a portion of reduced diameter and a second roll having a portion of increased diameter, said at least one of said upper and lower webs being sandwiched between said first and second rolls.

17. The apparatus of claim 16, wherein said first and second rolls are positioned at an angle greater than zero relative to said horizontal path.

* * * * *